United States Patent [19]

Minari

[11] Patent Number: 4,959,971

[45] Date of Patent: Oct. 2, 1990

[54] REFRIGERANT PIPING SYSTEM FOR REFRIGERATION EQUIPMENT

[75] Inventor: Katsunobu Minari, Toyoake, Japan

[73] Assignee: Hoshizaki Electric Co., Ltd., Toyoake, Japan

[21] Appl. No.: 414,685

[22] Filed: Sep. 29, 1989

[51] Int. Cl.[5] ..... F25C 5/10

[52] U.S. Cl. ..... 62/197; 62/196.4; 62/138; 62/352

[58] Field of Search ..... 62/197, 196.4, 196.3, 62/196.2, 196.1, 352, 278, 159, 160, 511, 81, 324.1, 324.5, 324.6, 135, 137, 138, 139

[56] References Cited

U.S. PATENT DOCUMENTS 2,704,924 3/1955 Nussbaum et al. ..... 62/196.4 X
4,519,214 5/1985 Sano et al. ..... 62/324.5 X
4,748,818 6/1988 Satterness et al. ..... 62/278 X
4,854,130 8/1989 Naruse et al. ..... 62/352

*Primary Examiner*—Harry B. Tanner
*Attorney, Agent, or Firm*—Brooks Haidt Haffner & Delahunty

[57] ABSTRACT

A refrigerant piping system for a refrigeration machine includes an injection pipe connected at one end thereof with the suction port of a compressor and at the other end with the outlet port of a condenser. The injection pipe is provided with a solenoid valve for suppressing a coolant from flowing into the compressor during a heating operation of the machine. By closing the solenoid valve during the heating operation, the liquid coolant is prevented from flowing into the compressor through the injection pipe.

8 Claims, 3 Drawing Sheets

REFRIGERANT PIPING SYSTEM FOR REFRIGERATION EQUIPMENT

BACKGROUND OF THE INVENTION

1. Field of the Invention

This invention relates generally to a refrigerant piping system for a refrigeration apparatus or equipment such as, for example, an ice making machine, refrigerator or the like which is provided with a compressor, a condenser, etc. More particularly, this invention is directed to a refrigerant piping system including an injection pipe which is connected to the discharge port of the condenser and the suction (intake) port of the compressor to supply a coolant or refrigerant to the compressor.

2. Description of the Prior Art

FIGS. 3 to 6 of the accompanying drawings show an example of a conventional automated ice making machine. Referring to FIGS. 4 and 5, a reference numeral 1 denotes generally a vertically mounted ice making plate comprising a stainless steel plate. The ice making plate 1 has a rear surface 1*a* provided with an evaporator 2 constituted by a meandering tube and installed thereon in a heat exchange relation. Formed integrally with the ice making plate 1 are a plurality of protrusions 3 which extend in the vertical direction in parallel with one another with a predetermined distance therebetween in the transverse or horizontal direction so that the ice making plate 1 presents as a whole a configuration like a corrugated plate. Thus, there are defined on the front surface 1*b* of the ice making plate 1 between the adjacent protrusions 3 a plurality of ice making surface areas or divisions 4 at locations corresponding, respectively, to the horizontally extending sections of the meandering tube constituting the evaporator 2. These surface areas 4 are destined to form thereon ice pellets 5 each of a semi-cylindrical form during an ice forming cycle.

Disposed above the ice making plate 1 is a deicing water distributing pipe 6 which is connected to a deicing water supply pipe (not shown) and which has a plurality of water distributing orifices 6*a* formed therein for supplying deicing water over the rear surface 1*a* of the ice making plate 1.

Next, referring to FIG. 3 which shows a refrigerant piping system incorporated in the ice making machine having the ice making plate assembly 1 as described above, the evaporator 2 constituted by the meandering tube is fluidly communicated at a lower end 2*a* thereof with a suction (intake) port of a compressor 8 through a first conduit 7. The compressor 8 has a discharge port which in turn is communicated with an inlet port of the condenser 10 through a second conduit 9. Further, the condenser 10 has an outlet port connected to an expansion valve 12 by way of a third conduit 11 which valve in turn is connected to the evaporator 2 at the upper end 2*b* thereof through a fourth conduit 13. Mounted at the lower end portion 2*a* of the evaporator 2 is a temperature sensor 12*b* for the expansion valve 12, which sensor is connected to the latter through a capillary tube 12*a*.

Connected between the second conduit 9 and the fourth conduit 13 at respective branching portions 9*a* and 13*a* is a hot gas pipe 14 in which a hot gas valve 15 is mounted. Further, an injection pipe 30 which interconnects the third conduit 11 and the first conduit 7 at respective branching portions 11*a* and 7*a* has incorporated therein a capillary tube 28.

FIG. 6 shows a control circuit 19 for controlling the icing/deicing operation cycles of the ice making machine equipped with the refrigerant piping arrangement described above. As will be seen in FIG. 6, the control circuit 19 includes an electronic controller 20 having a relay 21 which is provided with a normally closed contact X1 and a normally open contact X2. Connected to the electronic controller 20 are a water level responsive switch 22 for detecting completion of the icing operation cycle (i.e. ice making operation cycle) which switch is mounted within a raw water storage tank (not shown) for containing raw water to be supplied to the ice making plate assembly 1 and a temperature responsive switch 23 which is mounted on the ice making plate 1 for detecting completion of the deicing operation cycle (i.e. ice removing cycle). Connected to the normally closed contact X1 of the relay 21 are a pump motor 24 for driving a pump for circulating the raw water from the tank through the ice making plate assembly, and a fan motor 25 for cooling the condenser. On the other hand, there are connected to the normally open contact X2 the hot gas valve 15 constituting a part of the deicing circuit 27 and a feed water valve 26 for supplying the deicing water.

Now, description will be made of the operation of a prior art ice making machine of the structure described above. Upon power-on, the pump motor 24 is energized to supply the raw water to the ice making surface areas 4 of the ice making plate 1 from the raw water tank through a water distributing tube (not shown). At the same time, the fan motor 25 is rotated to cool the condenser 10 with the compressor 8 being concurrently actuated. Thus, the coolant condensed by the condenser 10 is forced to pass through the expansion valve 12 and the evaporator 2. In the course of passing through the evaporator 2, the coolant is vaporized by absorbing latent heat from the raw water flowing downwardly along the ice making plate, whereby the raw water is frozen to form the ice pellets 5 on the icing surface areas 4. A part of the liquid coolant resulting from condensation by the condenser 10 is fed back to the compressor 8 through the capillary tube 28 to cool the compressor 8 for the purpose of preventing the temperatures of the individual parts constituting the compressor 8 from rising excessively.

When the ice pellets 5 have grown to a predetermined size, the water level switch 22 detects a lowering of the water level within the unshown raw water tank to thereby energize the relay 21 in the electronic controller 20. As a result, the normally closed contact X1 is turned off (opened) while the normally open contact X2 is turned on (closed), stopping operation of the pump motor 24 and the fan motor 25. On the other hand, the feed water valve 26 and the hot gas valve 15 are energized to be opened to supply hot gas to the evaporator 2. At the same time, deicing water is distributed over the rear surface 1*a* of the ice making plate 1 from the deicing water distributing pipe 6 to start the deicing (or ice removing) operation cycle.

When all the ice pellets drop off from the ice making plate 1 in the deicing operation cycle, the temperature sensor switch 23 provided in association with the ice making plate 1 detects a corresponding temperature rise of the ice making plate to thereby terminate the deicing operation cycle.

As will be understood from the above description, in the case of the prior art refrigerant piping system, the hot gas valve 15 is opened during the deicing operation cycle to allow the high temperature gas discharged from the compressor 8 to flow through the evaporator 2, whereby a portion of each ice pellet 5 (the portion contacting the ice making plate) melts under the influence of heat carried by the hot gas to thereby cause the ice pellets to be detached and removed from the ice making plate. In the course of this process, the gas is condensed in the evaporator 2 to be transformed into a liquid coolant which then flows into the compressor 8. At that time, liquid coolant is additionally supplied from the injection pipe 30 having the capillary tube 28 to flow into the compressor 8. As a result, a large amount of the liquid coolant flows into the compressor 8 to cool the latter excessively, giving rise to problems in respect to the stable operation of the compressor 8.

SUMMARY OF THE INVENTION

It is an object of the present invention to solve the problem of the prior art refrigerant piping system exemplified by the ice making machine described above and to provide an improved refrigerant piping system for refriferation equipment which allows stable operation of a compressor even during a heating cycle.

In order to achieve the above and other objects which will be more apparent as description proceeds, this invention provides an improved refrigerant piping system incorporating therein an injection pipe with coolant inflow suppressing means. The coolant inflow suppression means can selectively assume the closed state or the open state. During the heating cycle, the coolant inflow suppression means is set to the closed state to prevent the liquid coolant from flowing into the compressor through the injection pipe.

In a preferred embodiment of the present invention, the coolant inflow suppression means may be constituted by a solenoid valve so constructed as to have inherently a flow throttling function. Alternatively, it may be constituted by a combination of a normal solenoid valve and addtional flow throttling means disposed upstream or downstream of the solenoid valve with respect to the direction of the coolant flow. Preferably, the additional coolant flow throttling means may be in the form of a capillary tube.

BRIEF DESCRIPTION OF THE DRAWINGS

A preferred embodiment of the invention will now be described, by way of example only, with reference to the accompanying drawings, in which.

DESCRIPTION OF THE PREFERRED EMBODIMENT

Figure 1:
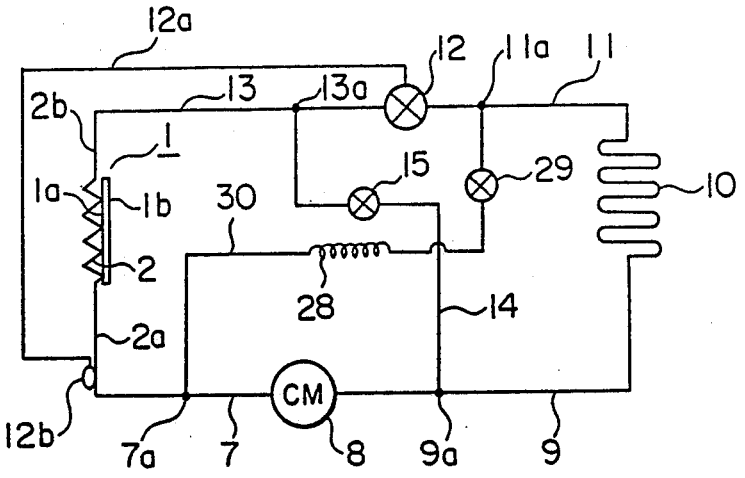
FIG. 1 shows a refrigerant piping system intended to be applied to an ice making machine according to an embodiment of the present invention.

Now, the invention will be described in detail in conjunction with preferred or exemplary embodiments thereof by reference to the accompanying drawings in which like reference numerals denote like or equivalent parts throughout several figures.

Figure 2:
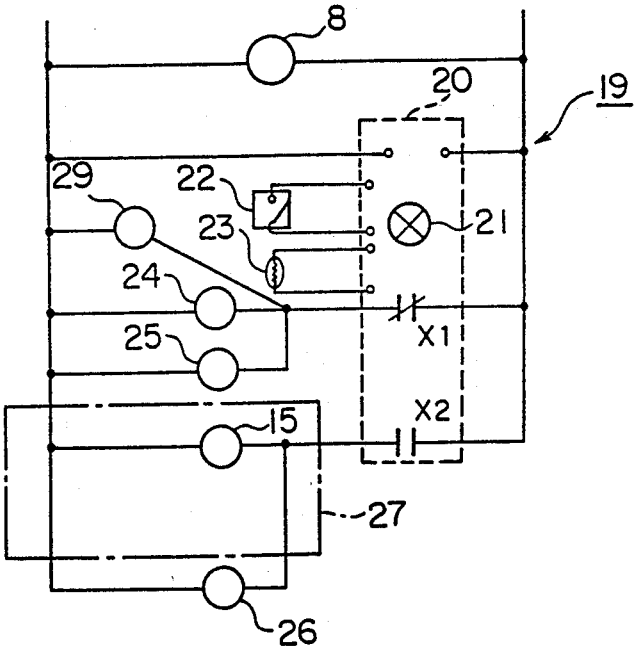
FIG. 2 shows a control circuit diagram employed for controlling the refrigerant piping system shown in FIG. 1.
Figure 3:
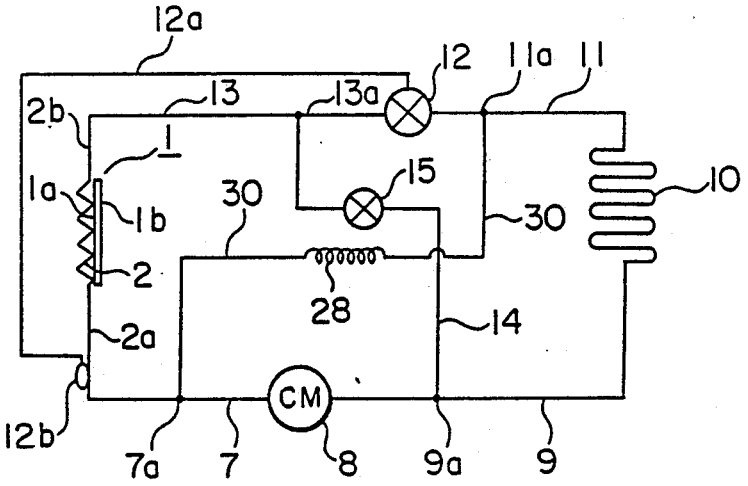
FIG. 3 (PRIOR ART)
FIG. 3 shows an example of the prior art refrigerant piping system for an ice making machine.

Referring to FIGS. 1 and 2, there are shown, respectively, a refrigerant piping system and a control circuit according to an exemplary embodiment of the invention, in which a reference numeral 1 generally denotes an ice making plate made of stainless steel and disposed substantially vertically. The ice making plate 1 has a rear surface **1*a* on which an evaporator 2** constituted by a meandering tube is mounted in heat exchange relation with the ice making plate.

Figure 4:
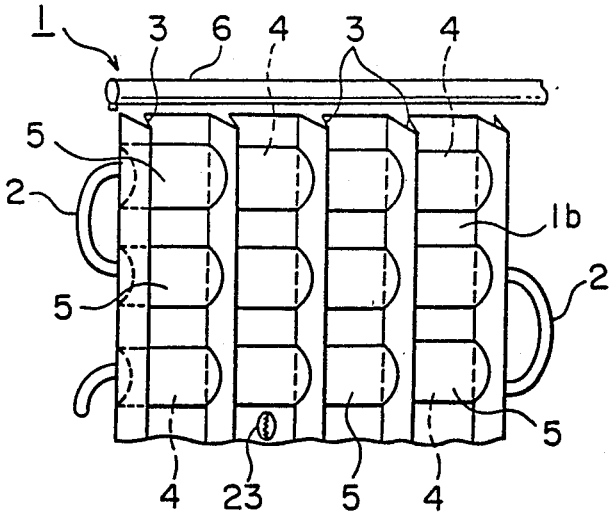
FIG. 4 (PRIOR ART)
FIG. 4 is a fragmental perspective view showing a portion of an ice making plate assembly of the prior art ice making machine.
Figure 5:
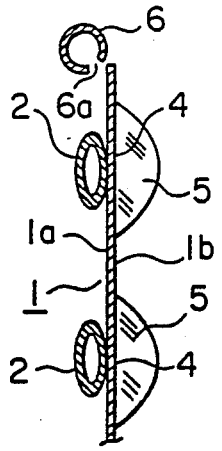
FIG. 5 (PRIOR ART)
FIG. 5 is an elevational view showing in section the ice making plate assembly shown in FIG. 4.
Figure 6:
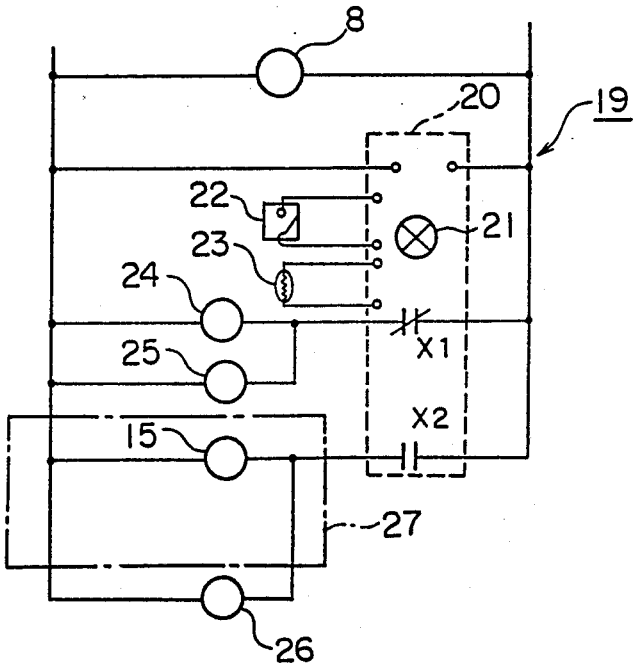
FIG. 6 (PRIOR ART)
FIG. 6 is a circuit diagram showing a control circuit for the conventional refrigerant system shown in FIG. 3.

For practical applications of the invention, the ice making plate 1 may be similar in structure to that shown in FIGS. 4 and 5 and has a plurality of protrusions (not shown) formed integrally therewith and vertically extending in parallel with one another with a predetermined distance therebetween so that the ice making plate 1 as a whole assumes a corrugated plate configuration. There are defined on a front surface **1*b* of the ice making plate 1 between the individual protusions a plurality of ice forming surface areas or divisions at locations substantially corresponding to horizontal sections of the meandering tube constituting the evaporator 2, respectively, on which ice pellets each of a semicylindrical shape are formed during an ice making operation cycle. Further installed above the ice making plate 1 are a deicing water distributing tube and a raw water distributing tube (both not shown) of the structure and disposition described hereinbefore in conjunction with FIGS. 4 and 5**.

Referring again to FIG. 1, an evaporator designated by reference numeral 2 has an exit or lower end portion **2*a* which is fluidly communicated with a suction (intake) port of the compressor 8 through a first conduit 7. On the other hand, the compressor 8 has a discharge port which is fluidly communicated with the inlet port of a condenser 10 through a second conduit 9. Further, the outlet port of the condenser 10 is connected to the inlet port of an expansion valve 12 through a third conduit 11, while the outlet port of the expansion valve 12 is connected to the inlet or upper end portion 2*b* of the evaporator 2 through a fourth conduit 13. An expansion valve temperature sensor 12*b* is mounted on the lower end portion 2*a* of the evaporator 2 and connected to the temperature responsive expansion valve 12 through a capillary tube 12*a***.

A branching portion **9*a* of the second conduit 9 interconnecting the discharge port of the compressor 8 and the inlet port of the condenser 10 and a branching portion 13*a* provided in the fourth conduit 13 and interconnecting the outlet port of the expansion valve 12 and the inlet port of the evaporator 2 are connected to each other through a hot gas pipe 14 having a hot gas valve 15 installed therein. Further, a branching portion 11*a* provided in the third conduit 11 which interconnects the condenser 10 and the expansion valve 12 between the outlet and inlet ports thereof, respectively, and a branching portion 7*a* of the first conduit 7 existing between the suction port of the compressor 8 and the outlet port of the evaporator 2 are connected to each other through an injection pipe 30 having a capillary tube 28. Additionally provided in the injection pipe 30** in series with the capillary tube 28 is an electrically operated solenoid valve 29 for suppressing or preventing the flowing of the coolant into the compressor 8.

Referring to FIG. 2, there is shown the control circuit 19 for controlling the icing/deicing (or ice making-/removing) operations of the ice making machine incorporating the refrigerant piping system described above, wherein the control circuit 19 comprises an electronic controller 20 including a relay 21 provided with a normally closed contact X1 and a normally open contact X2. Connected to the electronic controller 20 are a water level responsive switch 22 which is mounted within the raw water tank (not shown) for storing raw water to be supplied to the ice making plate 1 and serves to detect completion of the icing (ice making) operation cycle, and a temperature responsive switch 23 provided in association with the ice making plate 1 for detecting completion of the deicing (ice removing) operation cycle. Also, connected in series to the normally closed contact X1 of the relay 21 are a pump motor 24 for circulating the raw water through the ice making plate assembly 1 from the raw water tank, a fan motor 25 for the condenser, and the solenoid valve 29. On the other hand, there are connected to the normally open contact X2 of the relay 21 a hot gas valve 15 and a feed water valve 26 for supplying deicing water, both valves being electromagnetically operated and constituting parts of a deicing circuit 27.

Now, description will be turned to operation of the ice making machine described above. It is assumed that the raw water tank is filled to full with raw water. Upon turning-on of a main switch (not shown), the compressor 8 is driven with the pump motor 24 also being actuated to supply the raw water to the ice making plate assembly 1 from the tank, whereby the raw water is distributed over the ice forming plate surface. At the same time, the fan motor 25 is driven to cool the condenser 10 with the coolant resulting from condensation within the condenser 10 passing through the expansion valve 12 and the evaporator 2. At this time, the solenoid valve 29 is in the opened state. The coolant is vaporized in the course of flowing through the evaporator 2 by depriving the raw water of latent heat, as the result of which the raw water is frozen into ice pellets 5 on the ice forming surface areas 4. Further, since the solenoid valve 29 is opened, a part of the liquid coolant resulting from condensation in the condenser 10 is fed back to the suction port of the compresor 8 through the capillary tube 28 and serves for cooling the compressor 8 for thereby preventing the excessive increase in temperature of individual parts constituting the compressor 8.

As the ice pellets progressively grow, the water level within the tank is lowered correspondingly. At the time when the ice pellets have grown to a predetermined size, the water level within the raw water tank will be lowered to a predetermined level. The water level switch 22 detects this level, whereupon the relay 21 of the electronic controller 20 is electrically energized. As a consequence, the normally closed contact X1 is turned off (opened) with the normally open contact X2 being turned on (closed), which in turn results in that the electric power supply to the motor pump 24, the fan motor 25 and the solenoid valve 29 is interrupted while the feed water valve 26 and the hot gas valve 15 are energized simultaneously. Upon stopping of operation of the pump motor 24 and the fan motor 25, the supply of raw water and the cooling of the condenser are interrupted to thereby terminate the icing operation cycle. At the same time, the coolant supply to the suction port of the compressor 8 through the injection pipe 30 is intercepted because the solenoid valve 29 is closed. On the other hand, because of opening of the feed water valve 26 and the hot gas valve 15, the deicing water is distributed over the rear surface 1*a* of the ice making plate 1 from the deicing water distributing pipe while a hot gas is supplied to the evaporator 2 to start the deicing operation cycle or heating cycle.

When all the ice pellets have doropped off from the ice making plate 1 as the the deicing operation proceeds, the temperature sensor switch 23 provided in association with the ice making plate 1 detects a temperature rise thereof to terminate the deicing operation cycle.

In the refrigerant piping system of the ice making machine described above, the normally open contact X2 of the relay 21 is closed upon start of the deicing operation cycle to thereby allow the hot gas valve 15 to be opened. As a result, high temperature gas discharged from the compressor 8 flows into and through the evaporator 2, whereby a portion of each ice pellet (the portion contacting the ice making plate) melts under heating by the high temperature gas. Thus, the ice pellets are detached and removed from the ice making plate. During the deicing operation cycle, the gas is condensed within the condenser 2 to be thereby transfromed into a liquid coolant, which then flows into the compressor 8. However, since the normally closed contact X1 is opened to thereby close the solenoid valve 29 at that time point, the lequid coolant from the capillary tube 28 is prevented from flowing into the flowing into the compressor 8. In this manner, the compressor 8 is protected from being cooled excessively.

In the foregoing description of the preferred embodiment, it has been assumed that the present invention is applied to an ice making machine. However, it may be understood that the invention can also be applied to a defrosting circuit of a refrigerator incorporating the injection pipe, as will be readily understood by those skilled in the art. Further, it is to be added that as far as the solenoid valve 29 has a function to throttle the flow of the liquid coolant, the capillary tube 28 in the injection pipe 30 may be spared. In that case, only the solenoid valve 29 constitutes the coolant inflow suppressing means. In the embodiment, although the solenoid valve 29 is provided at a location of the injection pipe 30 upstream of the capillary tube 28, it may be provided at a location downstream of the capillary tube 28. Furthermore, in the embodiment, the solenoid valve 29 is so connected to the normally closed contact X1 as to be closed upon opening of the latter. However, it will be readily appreciated that the solenoid valve 29 may be connected to the normally open contact X2 instead of the normally closed contact X1 so that it is opened upon start of the deicing operation cycle in response to the closing of the normally open contact X2.

As will now be appreciated from the foregoing, in the refrigerant piping system according to the present invention, the solenoid valve is closed during the heating cycle to thereby prevent the liquid coolant from flowing into the compressor from the injection pipe during the heating cycle. By virture of this arrangement, the compressor is protected from being excessively cooled even during the heating cycyle, whereby stable and effective operation of the compressor and hence of the refrigerant piping system as a whole can be assured.

It is thought that the invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

What I claim is:

1. A refrigerant piping system for a refrigeration machine repeating a heating operation and a cooling operation, comprising:

a closed coolant loop including a compressor having a suction port and a discharge port, a condenser having an inlet port and an outlet port, an expansion valve having an inlet port and an outlet port, and an evaporator having an inlet port and an outlet port, said compressor, said condenser, said expansion valve and said evaporator being sequentially connected in series to one another to form said closed coolant form;

a hot gas pipe connected in said closed coolant loop so as to be comunicated with said loop at locations between the discharge port of said compressor and the inlet port of said condenser on one hand and between the outlet port of said expansion valve and the inlet of said evaporator on the other hand, said hot gas pipe including a hot gas valve which is opened during the heating operation and closed during the cooling operation of said refrigeraton machine;

an injection pipe connected at one end between the outlet port of said condenser and the inlet port of said expansion valve and connected at the other end between the outlet port of said evaporator and the suction port of said compressor; and said injection pipe being provided with coolant inflow suppressing means adapted to be closed during the heating operation while being opened during the cooling operation, whereby liquid coolant resulting from condensation in said condenser is prevented from flowing into said compressor through said injection pipe during the heating operation.

2. A refrigerant piping system according to claim 1, wherein said coolant inflow suppressing means comprises a solenoid valve having a function of throttling the flow of the coolant passing therethrough.

3. A refrigerant piping system according to claim 1, wherein said coolant inflow suppressing means comprises a solenoid valve, and a capillary tube connected in series to said solenoid valve.

4. A refrigerant piping system according to claim 3, wherein said solenoid valve is provided upstream of said capillary tube with respect to the direction of the coolant flow therethrough.

5. A refrigerant piping according to claim 3, wherein said solenoid valve is provided downstream of said capillary tube with respect to the direction of the coolant flow therethrough.

6. A refrigerant piping system according to claim 1, wherein said refrigeration machine is an ice making machine.

7. A refrigerant piping system according to claim 1, wherein said refrigeration machine is a refrigerator.

8. A refrigerant piping system according to claim 6, wherein said ice making machine includes first detecting means for detecting completion of the cooling operation, second detecting means for detecting completion of the heating operation, and a control circuit connected to said first and second detecting means for allowing said ice making machine to carry out the heating operation upon detection of completion of the cooling operation by said first detecting means and for allowing said ice making machine to carry out the cooling operation upon detection of completion of the heating operation by said second detecting means, and wherein said coolant inflow suppressing means is connected to said control circuit so as to intercept said injection pipe in response to the detection of completion of the cooling operation by said first detecting means.

* * * * *